US008451186B2

(12) United States Patent
Huettner

(10) Patent No.: US 8,451,186 B2
(45) Date of Patent: May 28, 2013

(54) SYSTEM AND METHOD FOR PASSIVE PROTECTION OF AN ANTENNA FEED NETWORK

(75) Inventor: Steve E. Huettner, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1640 days.

(21) Appl. No.: 11/904,077

(22) Filed: Sep. 26, 2007

(65) Prior Publication Data

US 2012/0212392 A1 Aug. 23, 2012

(51) Int. Cl.
*H01Q 3/24* (2006.01)

(52) U.S. Cl.
USPC ..... 343/876; 343/853

(58) Field of Classification Search
USPC ..... 343/700 MS, 853, 876
See application file for complete search history.

(56) References Cited

U.S. PATENT DOCUMENTS

| | | | | |
|---|---|---|---|---|
| 6,686,885 | B1 * | 2/2004 | Barkdoll et al. | 343/700 MS |
| 6,744,411 | B1 * | 6/2004 | Osterhues et al. | 343/754 |
| 7,164,387 | B2 * | 1/2007 | Sievenpiper | 343/702 |
| 7,228,156 | B2 * | 6/2007 | Gilbert | 455/562.1 |
| 7,683,844 | B2 * | 3/2010 | Alamouti et al. | 343/754 |
| 2008/0062037 | A1 * | 3/2008 | Edvardsson | 342/124 |
| 2009/0156137 | A1 * | 6/2009 | Rofougaran et al. | 455/77 |
| 2011/0175791 | A1 * | 7/2011 | Ozdemir et al. | 343/876 |

* cited by examiner

*Primary Examiner* — Tho G Phan
(74) *Attorney, Agent, or Firm* — Schwegman Lundberg & Woessner, P.A.

(57) ABSTRACT

A system and method for providing overvoltage and overcurrent protection. The present teachings provide a method for protecting a component including the steps of: 1) connecting a first terminal of a normally open micro-electro-mechanical systems (MEMS) switch to a source of an input signal with respect to the component; 2) connecting a second terminal of the switch to an input to the component; and 3) connecting a third terminal of the switch to a source of control potential to activate the switch on the application of power thereto. In a most general embodiment, the invention provides an arrangement for protecting a component comprising a MEMS switch having a first terminal coupled to a source of an input signal; a second terminal coupled to said component; and a third terminal adapted to activate the switch on the application of control power thereto. In the best mode, the switch is normally open, the first terminal is a drain terminal, and the second terminal is coupled to a source of ground potential. In an illustrative application, the invention is used in an antenna having an array of antenna elements and a MEMS switch coupled to at least one of the elements to provide over-voltage and/or over-current protection. In the best mode, a separate MEMS switch is coupled to each element in the array in a normally open configuration via the drain terminal thereof.

1 Claim, 4 Drawing Sheets

SYSTEM AND METHOD FOR PASSIVE PROTECTION OF AN ANTENNA FEED NETWORK

BACKGROUND OF THE INVENTION

1. Field of the Invention

The present invention relates to electronic and electrical systems. More specifically, the present invention relates to systems and methods for electronic circuit and component protection.

2. Description of the Related Art

In many applications, there is a need for a scheme for protecting an electronic circuit from ambient radiation. One such application involves the use of radar-guided weapons. Radar-guided weapons such as Small Diameter Bomb II (SDB-II) will make many flights while strapped to the wing of an aircraft, in an un-powered (passive) state. As the aircraft takes off and lands or is parked, there is no way to control the illumination that might be present due to other radars, and the weapon should protect itself so that no damage is inflicted. A prediction of the maximum signal strength environment that systems such as SDB-II might experience is shown in FIG. 1.

There are two regions on the curve that severely stress the system. These are approximately Ku-band: 120 W peak, 600 mW average and Ka-band: 100 W peak, 2 watts average.

However, the analysis provides only an estimate that may prove to be optimistic. A goal for a protection system might be to harden the front-end to 1000 watts peak, 10 watts average, at any frequency from X through Ka-band. It should be noted that typical stray radar signals are high peak power but low average power.

A radar guided weapon front-end typically employs a combination of passive and active circuitry to provide required transmit power and set system noise figure. The active components should be protected, or "hardened" from stray radiation. The protection device should be provided in front of the active circuitry. It should act passively, to protect the system in the absence of prime power. When the system is turned on, the protection system should have a minimal effect on transceiver performance, i.e. it should not severely degrade output power during transmit or noise figure during receive. Ideally, the protection system will have minimal impact on radar figure of merit (FOM), the ratio of transmit output power to receive noise figure of the radar.

There are four major characteristics that are important for passive protection: 1) size; 2) cost; 3) effect on transceiver performance, i.e., minimize hit on radar figure of merit; and 4) protection power level and bandwidth.

A conventional method for passive protection involves the use of PIN diode limiters. PIN diode limiters can be an effective solution with respect to the above-noted desirable characteristics at X-band. PIN diode limiters can be made to handle enormous power levels but the bandwidth of PIN diode limiters is limited. However, future radar guided weapons may operate at Ka-band. The typical insertion loss of a 1000 peak watt PIN diode limiter at Ka-band may yield a radar figure of merit that is unacceptable for future requirements. Thus, there is a need for an improved passive protection system that operates at Ka-band frequencies and maintains the highest performance FOM.

Prior approaches for passive protection have primarily involved X-band missiles. The conventional X-band solution is to employ passive limiters at the front-end of the active electronics.

In this conventional approach, the first component that is seen by a received signal that passes from antenna to comparator network to transceiver is a passive limiter. Because of the nature of the comparator network, it is possible that the vast majority of a stray radar signal that uniformly illuminates the antenna may combine at a single transceiver channel, most likely the SUM channel. Therefore a typical 1000 watt peak uniform-illumination input to the antenna/feed requires that each transceiver input should be hardened to withstand 1000 watts peak if the feed and comparator network are considered lossless.

While schemes have been developed to make the PIN diode approach work for X-band radiation, the mere fact that PIN diode passive protection schemes can be made to work well for X-band does not provide a solution that is ideal for Ka-band. That is, the loss of a high-power limiter for a given protection level increases with center frequency. Hence, a solution that only affects radar FOM by one dB at X-band might surpass 3 dB at 35 GHz, which is an unacceptable solution for future applications.

Protective shrouds placed over the antenna have been considered, however, this approach is cumbersome and adds cost and weight to the system.

Hence, a need remains in the art for a system or method for protecting antenna feed networks and other sensitive electronic devices from stray radiation and other adverse electromagnetic fields.

SUMMARY OF THE INVENTION

The need in the art is addressed by the system and method for providing overvoltage and overcurrent protection of the present invention. The present teachings provide a method for protecting a component including the steps of: 1) connecting a first terminal of a normally open micro-electro-mechanical systems (MEMS) radio frequency (RF) switch to a source of an input signal with respect to the component; 2) connecting a second terminal of the switch to an input to the component; and 3) connecting a third terminal of the switch to a source of control potential to activate the switch on the application of power thereto.

In a most general embodiment, the invention provides an arrangement for protecting a component comprising a MEMS switch having a first terminal coupled to a source of an input signal; a second terminal coupled to said component; and a third terminal adapted to activate the switch on the application of power thereto. In the best mode, the switch is normally open, the first terminal is a drain terminal, and the second terminal is coupled to a source of ground potential.

In an illustrative application, the invention is used in an antenna having an array of antenna elements and a MEMS switch coupled to at least one of the elements to provide over-voltage and/or over-current protection. In the best mode, a MEMS switch is coupled to each element in the array in a normally open configuration via the drain terminal thereof.

In more specific application, the invention integrates MEMS switches within a feed network to provide passive protection for microwave or millimeter-wave radar-guided weapons from electromagnetic environments (EME) due to ship-borne, airborne and airport high-power radar illumination.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

As noted above, prior approaches for passive protection have primarily involved X-band missiles. This approach is discussed below in more detail to provide a background for a disclosure of the present teachings. The conventional X-band solution is to employ passive limiters at the front-end of the active electronics.

Figure 1:
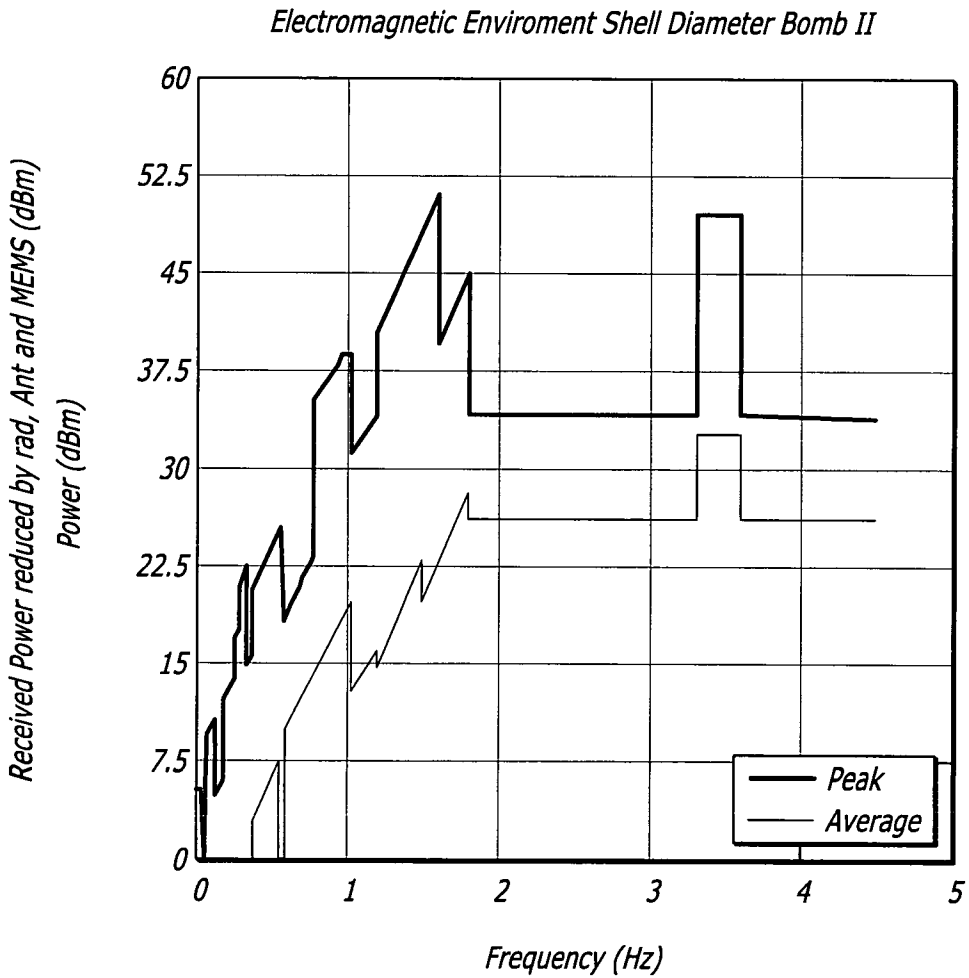
FIG. 1 (Prior Art)
FIG. 1 is a graph showing stray power levels applied to the equivalent single input of an SDB-II radar to in an illustrative electromagnetic environment in accordance with conventional teachings.
Figure 2:
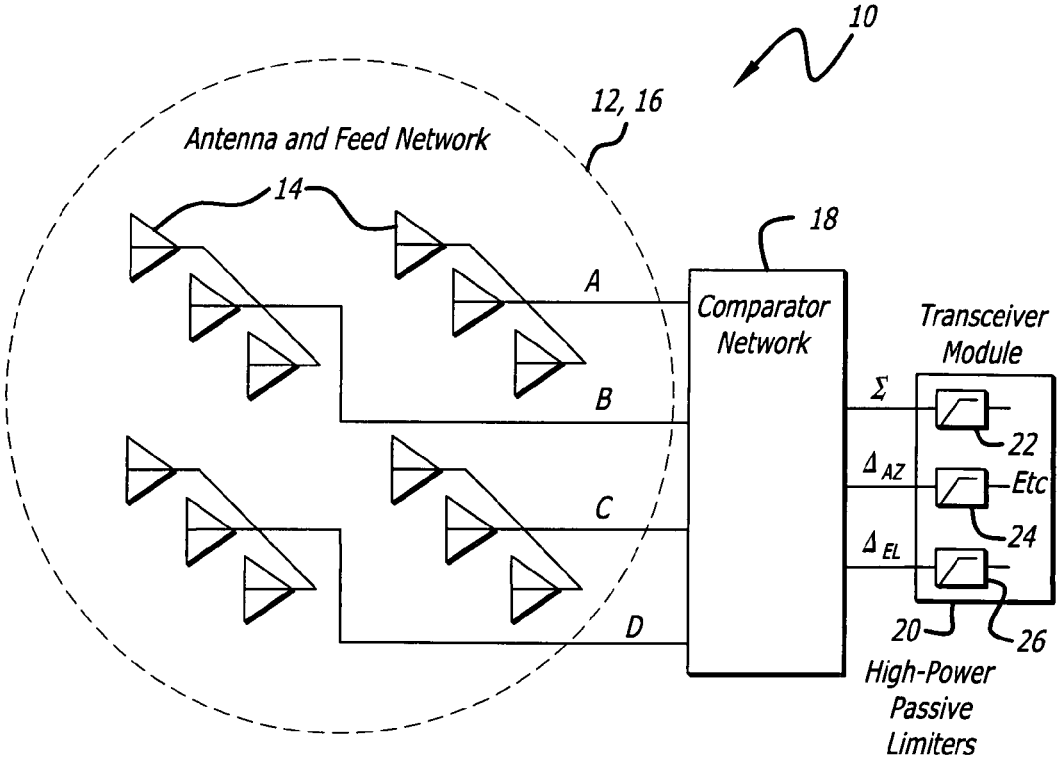
FIG. 2 (Prior Art)
FIG. 2 shows a front-end of a generic radar-guided weapon that uses monopulse tracking with passive limiters inside a transceiver module in accordance with conventional teachings.

FIG. 2 shows a front-end of a generic radar-guided weapon that uses monopulse tracking with passive limiters inside a transceiver module in accordance with conventional teachings. In FIG. 2, the system 10 includes an array 12 of twelve radiating elements 14. The outputs of the radiating elements 14 are combined in a feed network 16 to form four beams (A, B, C and D). These four beams are processed by the comparator network 18 to arrive at SUM and two DELTA signals that are well known to those involved in radar guidance. These three signals are processed by a three-channel transceiver module 20, which contains active components that need to be protected from stray electromagnetic environments (EME) radiation.

Figure 3:
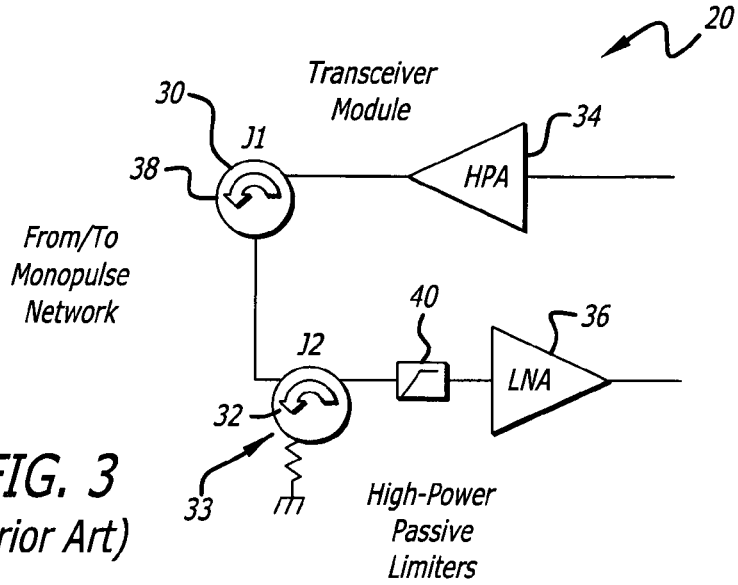
FIG. 3 (Prior Art)
FIG. 3 is a schematic diagram of a Type A embodiment of a transceiver module in accordance with conventional teachings.
Figure 4:
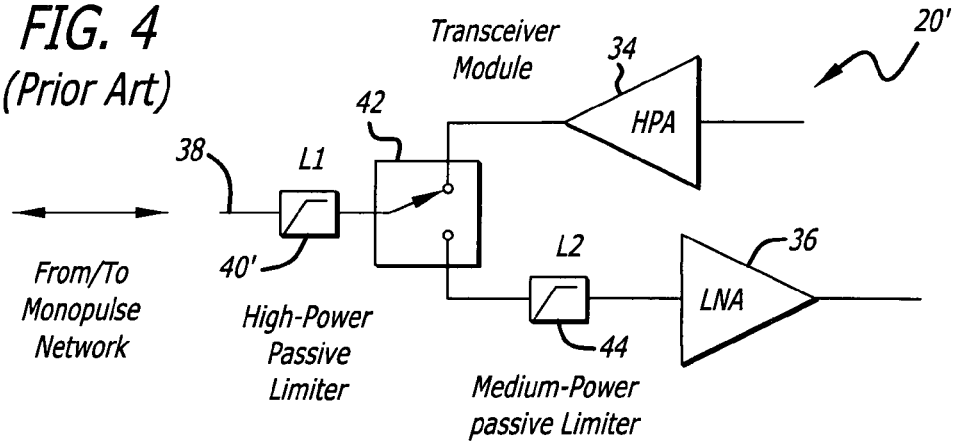
FIG. 4 (Prior Art)
FIG. 4 is a schematic diagram of a Type B embodiment of a transceiver module in accordance with conventional teachings.

In this conventional approach, the first component that is seen by a received signal that passes from comparator network to transceiver is a passive limiter 22, 24 or 26. Due to the nature of the comparator network 18, it is possible that the vast majority of a stray radar signal that uniformly illuminates the antenna may combine at a single transceiver channel, most likely the SUM channel. Therefore a 1000 watt peak input signal distributed uniformly to the antenna/feed requires that each transceiver input should be hardened to withstand 1000 watts peak if the feed and comparator network are considered lossless. FIGS. 3 and 4 illustrative conventional approaches to handling the 1000 watt peak signals within the transceiver using limiters in accordance with conventional teachings.

FIG. 3 is a schematic diagram of a Type A embodiment of a transceiver module in accordance with conventional teachings.

FIG. 4 is a schematic diagram of a Type B embodiment of a transceiver module in accordance with conventional teachings.

In the transceiver block diagram "Type A" (FIG. 3), a pair of ferrite circulators 30 (J1) and 32 (J2) are used to duplex the transceiver's high power amplifier (HPA) 34 and low noise amplifier (LNA) 36 to the common RF input 38. This option is used where performance is more important than cost, and where there is sufficient space (circulators are typically the largest components in transceivers). This set-up offers excellent protection with minimal radar FOM impact. When EME is present, it is effectively reflected by the passive limiter 40, and then dissipated in the load that is attached to circulator J2 33. The approach is limited in bandwidth to perhaps 10-20%.

In the "Type B" solution (FIG. 4), a SPDT switch 42 is used to duplex the transceiver's high power amplifier (HPA) 34 and low-noise amplifier (LNA) 36 to the common port 38. In this embodiment two different limiters are used, L1 40' has a compression characteristic that will pass the full output power (e.g. 4 watts peak) of the transmit high-power amplifier 34 unattenuated, but will reject signals that exceed this level (perhaps 10 watts leakage from a 1000 watt electromagnetic environment (EME) signal). This limiter protects the switch 42 and HPA 34 in the event of a high-power EME signal.

The second limiter L2 is needed to further protect the LNA 36 from an EME signal. Inasmuch as it has a lower power/damage threshold this limiter might have a flat leakage power of less than 100 mW. The bandwidth of this type of setup is typically limited to perhaps 10-20%, similar to the Type A setup of FIG. 3. The Type B arrangement may have a more deleterious affect on radar FOM compared to Type A because the combined insertion losses of the limiters will be high. However, it should be less expensive and occupy less area.

The present invention utilizes MEMS switches, in the best mode, single-pole, single-throw (SPST) cantilevered series switches to provide passive protection for active electronic devices. As it is normally open, a MEMS switch provides broadband isolation over far more bandwidth than a shunt PIN diode limiter, for small to moderate signal levels.

Figure 5:
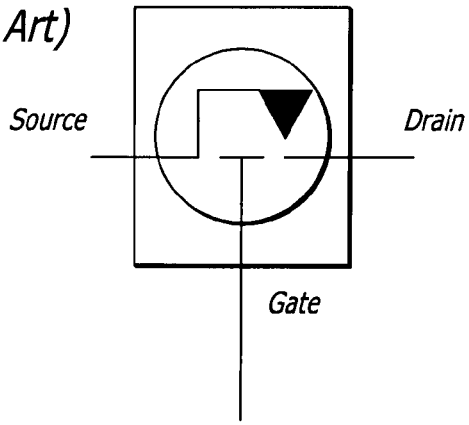
FIG. 5 (Prior Art)
FIG. 5 is a schematic representation of a MEMS ohmic-type MEMS switch in accordance with conventional teachings.

FIG. 5 is a schematic representation of a MEMS ohmic-type MEMS switch in accordance with conventional teachings. Such switches are currently commercially available. See, for example, the model RMSW200 switch sold by Radant of Stow, Mass. (http://www.radantmems.com/radant-mems/coinfo.html). Note that the "gate" electrode is electrically isolated from the RF line ("source" and "drain"). This feature offers improved peak power handling, inasmuch as high-power RF signals are not likely to self-actuate the switch as might be the case in other MEMS switch configurations. The insertion loss of the switch (typically on the order of 0.5 dB at 35 GHz) is far below the expected insertion loss of a PIN diode limiter.

Not much data has been published on the peak power handling of MEMS circuits. It turns out that these devices can typically handle far more peak power in the OPEN position than the average power that can be handled in the CLOSED position. The peak power limitation is due to the peak RF voltage that occurs before failure is manifested by arcing across the contacts. The voltage across the contacts due to high-power RF is:

$$Vpeak=1.414\times2\times SQRT(P\times Z0) \quad [1]$$

The "2" in the equation is because the standing wave of an open circuit doubles the peak voltage.

Figure 6:
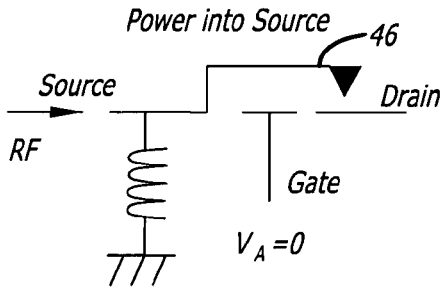
FIG. 6 (Prior Art)
FIG. 6 is a schematic diagram illustrating a MEMS switch with power applied to the source terminal thereof.

FIG. 6 is a schematic diagram illustrating a MEMS switch with power applied to the source terminal thereof.

Figure 7:
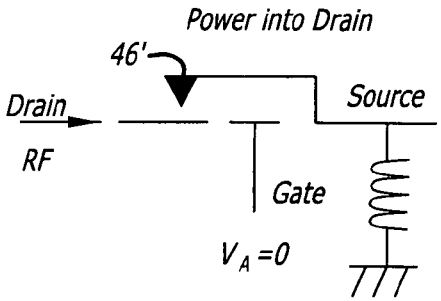
FIG. 7 (Prior Art)
FIG. 7 is a schematic diagram illustrating a MEMS switch with power applied to the drain terminal thereof.

FIG. 7 is a schematic diagram illustrating a MEMS switch with power applied to the drain terminal thereof. FIGS. 6 and 7 illustrate why the power handling of the MEMS switch is influenced by which terminal the high-power signal is incident on, when self-actuation is considered. If the signal is incident on the source as shown in FIG. 6, the full RMS (root mean square) signal acts to pull down the beam 46 and close the switch. This would cause the switch to fail because the voltage could cause electro-static discharge just as the switch closed (this would occur at 65 VRMS in the case of Radant's RMSW200 data sheet), or a power level of 21 watts peak from Equation [1]).

If power is incident on the drain as shown in FIG. 7, the RMS voltage that develops to pull down the beam 46' is reduced by the radio-frequency (RF) isolation of the switch. Even if the switch has only 10 dB isolation, the RMS voltage on the source may be reduced to 31.2% of the RMS value that is incident on the drain. According to stated specifications, the Radant switch requires 65 volts to actuate, so an RF field of over 200 volts would be required to self-actuate. Therefore the peak power handling limitation is only that voltage breakdown eventually occurs across the source-drain gap during the pulse at power levelS around 80 watts peak.

In accordance with the present teachings, the switch is configured so that EME power is incident on the drain.

In accordance with the present teachings, MEMS switches are used in the feed network. This is illustrated in FIG. 8.

Figure 8:
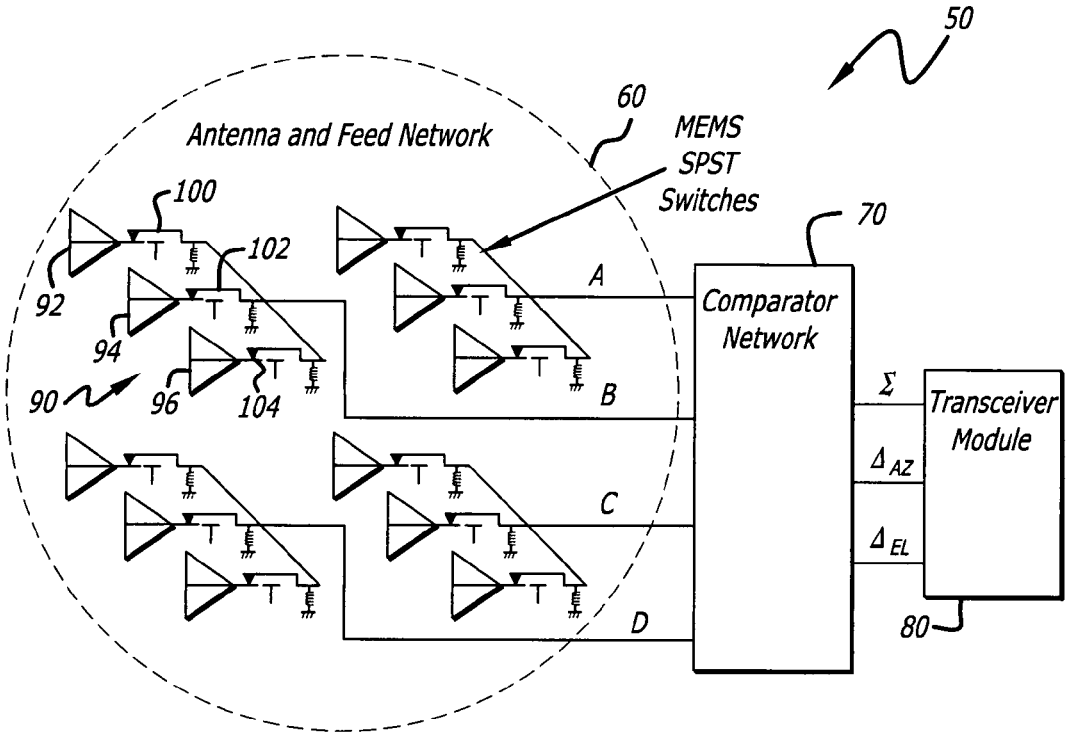
FIG. 8 is a schematic diagram of a front-end with MEMS SPST switches distributed in the feed network thereof accordance with an illustrative embodiment of the present teachings.

FIG. 8 is a schematic diagram of a front-end with MEMS SPST switches distributed in the feed network thereof accordance with an illustrative embodiment of the present teachings. The arrangement 50 of FIG. 8 shows an inventive antenna array and feed network 60. The output of the antenna and feed network 60 is fed to a comparator network 70 and a transceiver module 80. The antenna and feed network 60 includes an antenna array 90 of radiating elements 92, 94, 96, etc. In accordance with a preferred embodiment of the present teachings, one SPST MEMS switch 100, 102 and 104 is provided for each radiator. This distribution of MEMS switches within the antenna feed network serves to maximize the total power handling of the network. For a MEMS switch that can survive 80 watts without voltage breakdown, a 12-element antenna array with 12 MEMS switches could survive 960 watts peak under uniform illumination.

In the best mode, a Radant MEMS switch with a low-loss feed technology, such as Rohm and Haas PolyStrata™ rectangular coax will be used inasmuch as this switch should offer protection, small size and minimal effect on transceiver performance. The MEMS devices should be packaged in hermetic chip-scale packages, so they can be integrated to this type of transmission line with non-hermetic surface-mount interconnect such as bumped flip-chip.

For most applications, a successful incorporation of any component into an antenna feed suggests that the variation from one element to the next should be extremely small. Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An antenna system comprising:

a comparator network;

a feed network;

a transceiver module coupled to the comparator network and arranged to process a sum signal and two delta signals;

an array of antenna elements; and a normally open micro-electro-mechanical systems (MEMS) switch coupled to each of said antenna elements and the feed network with rectangular coax transmission line, each of the MEMS switches being normally open and having:

a drain terminal coupled to an antenna element;

a source terminal coupled to the feed network; and a gate terminal adapted to activate said switch on the application of control power thereto to provide overcurrent and overvoltage protection for the transceiver module, wherein the MEMS switches are packaged in hermetic chip-scale packages and coupled to the rectangular coax transmission lines with non-hermetic surface-mount interconnects, wherein the feed network is arranged to combine outputs from the source terminals to generate a number of beams and the comparator network is arranged to provide the sum signal and the two delta signals from the number of beams, and wherein the transceiver module is devoid of high-power passive limiters.

* * * * *

UNITED STATES PATENT AND TRADEMARK OFFICE

CERTIFICATE OF CORRECTION

PATENT NO. : 8,451,186 B2
APPLICATION NO. : 11/904077
DATED : May 28, 2013
INVENTOR(S) : Steve E. Huettner It is certified that error appears in the above-identified patent and that said Letters Patent is hereby corrected as shown below:

In the Specification:

In column 1, line 29, before “to”, insert --used--, therefor

In column 2, line 65, delete “to in” and insert --in to--, therefor

In column 5, line 28, delete “levelS” and insert --levels--, therefor

In column 6, line 4, after “so”, insert --that--, therefor

Signed and Sealed this
Fifteenth Day of October, 2013

Teresa Stanek Rea
*Deputy Director of the United States Patent and Trademark Office*